US006125639A

United States Patent [19]

Newman et al.

[11] Patent Number: 6,125,639

[45] Date of Patent: Oct. 3, 2000

[54] METHOD AND SYSTEM FOR ELECTRONICALLY CONTROLLING THE LOCATION OF THE FORMATION OF ICE WITHIN A CLOSED LOOP WATER CIRCULATING UNIT

[75] Inventors: Todd R. Newman, Traverse City; David Shank, Big Rapids; Robert E. Taylor, Cadillac, all of Mich.

[73] Assignee: Nartron Corporation, Reed City, Mich.

[21] Appl. No.: 08/831,678

[22] Filed: Apr. 10, 1997

Related U.S. Application Data

[63] Continuation of application No. 08/522,848, Sep. 1, 1995, Pat. No. 5,653,114.

[51] Int. Cl.[7] ..... F25C 1/12

[52] U.S. Cl. ..... 62/74; 62/347

[58] Field of Search ..... 62/74, 347

[56] References Cited

U.S. PATENT DOCUMENTS 4,785,641 11/1988 McDougal ..... 62/347

4,959,966 10/1990 Dimijian ..... 62/138

5,582,018 12/1996 Black et al. ..... 62/74

*Primary Examiner*—William E. Tapolcai

*Attorney, Agent, or Firm*—Brooks & Kushman P.C.

[57] ABSTRACT

A method and system for electronically controlling the location of the formation of ice within a closed loop water circulating unit. A method and system is provided for making ice using supercooled water. When a desired degree of supercooling is reached in the closed loop water circulating unit, a pump associated with the ice-making machine is stopped so as to initiate ice seeding on the ice mold. After the pump is restarted, the supercooled water flows over the seeded molds to rapidly form ice on the ice molds. A method and system is also provided for improving the clarity of the ice. Water is preheated prior to introducing the water to the closed loop water circulating unit. Furthermore, in an ice-making machine having two or more ice molds, a method and system is provided for allowing one mold to act as a condenser in a harvest mode, while simultaneously allowing the remaining molds to act as evaporators in the freezing mode. Another ice-making apparatus is provided for decreasing the cycle time for forming ice. A fine spray of supercooled water is sprayed onto a chilled ice mold resulting in little or no run off water to recirculate.

11 Claims, 5 Drawing Sheets

METHOD AND SYSTEM FOR ELECTRONICALLY CONTROLLING THE LOCATION OF THE FORMATION OF ICE WITHIN A CLOSED LOOP WATER CIRCULATING UNIT

This application is a continuation of application of Ser. No. 08/522,848, filed Sep. 1, 1995, now U.S. Pat. No. 5,653,114.

TECHNICAL FIELD

This invention relates to ice-making machines, and more particularly, to methods and systems for electronically controlling the location of the formation of ice within a closed loop water circulating unit.

BACKGROUND ART

In conventional home freezer systems, an ice-making machine includes at least one ice mold. However, more sophisticated systems may include a series of ice molds. In order to make ice, the ice mold is first filled with cold tap water. The water and ice mold are then cooled by heat conduction through a surface which the ice mold is placed upon. The water and ice mold are also cooled by convection through the air located above the water and the ice mold. As heat is extracted, the water is slowly converted to ice. However, this method for forming ice cubes can take an hour or more.

The above described process is too slow to provide an adequate supply of ice cubes in a restaurant or vending machine application without the use of a large freezer and several ice molds. To circumvent this problem, commercial ice makers use ice molds that are cooled directly through circulating refrigerant. Consequently, cooling capacity is delivered directly and rapidly to the ice molds. Commercial ice makers are also designed to automatically fill the ice molds with water when they are empty and to automatically empty the ice molds when they are filled with ice.

The challenges associated with automatic ice-making are several and include the following: preventing freezing in pumps and plumbing when supercooled water is circulated, achieving uniform and rapid filling of all the ice molds, achieving complete and uniform freezing in all the ice molds, achieving complete release of the ice cubes from the ice molds when freezing is complete, minimizing freezing time and energy consumption, and achieving a high yield. It is also desirable in some cases to produce ice cubes with a high degree of clarity.

When liquid water is cooled to 32° F., the water begins to freeze. The freezing of the water will take place as the heat of fusion (79.7 cal/gram) is removed. During freezing a water-ice mixture is present, and the water and ice remains at a temperature of 32° F. until freezing is complete, assuming there is adequate thermal contact between the water and ice. Once freezing is completed, the temperature of the ice will drop as more heat is extracted. Freezing will also begin if an ice piece or other suitable "seed" crystal is present in sub-freezing (≦32° F.) water. A seed crystal initiates ice growth starting at the surface of the seed and progressing outward. Freezing can also be initiated in sub-freezing water if the water is subjected to a sudden vibration. At low enough temperatures, a tap on the side of the container holding the sub-freezing liquid can be sufficient to initiate freezing.

Absent a seed crystal or vibration, it is possible to cool water to a temperature below 32° F. Once water is cooled below its freezing point, i.e., 32° F., it is considered to be supercooled. Supercooled water will rapidly begin to freeze when exposed to a "seed" crystal, sharp vibration or small vibrations at extremely low temperatures. Due to the 79.7 cal/gram heat of fusion, it is possible for a given mass of supercooled water to have more heat content than the same mass of ice at 32° F. For instance, the heat content of 10 grams of 8° F. liquid water is 2166 cal while the heat content of 10 grams of 32° F. ice is 1502 cal. There is considerably more heat (44% more) in the liquid water than in the ice. Yet, the water is at a lower temperature than the ice. In order for the 8° F. water to freeze entirely, its extra 664 cal (2,166–1,502) of heat content would have to be rejected to ambient air.

If approximately 16.7% of the 8° F. water were converted to ice at 32° F. and approximately 83.3% was to remain in a liquid state at 32° F., the heat content would be 2166 cal which is the same heat content as the original 8° F. water. This is essentially what happens once freezing is initiated in supercooled water. A volume of a gallon or more of supercooled water at a sub-freezing temperature will convert to a slush (small ice particles+water) in a matter of seconds once freezing has been initiated. When the supercooling is eliminated through freezing, the freezing stops. The ratio of ice to liquid is dependent on the degree of supercooling in the liquid water before the formation of ice has occurred.

FIG. 1 illustrates the fraction of liquid water in a slush mixture, following its formation from supercooled water, as a function of the initial temperature of the supercooled water. As can be seen, 27° F. water can be expected to form a slush mixture of 97% liquid water and 3% ice. Similarly, –20° F. water will form a slush mixture of 64% liquid water and 36% ice. Also, note that –111° F. water will form solid ice.

An automatic ice-making system typically has some degree of plumbing associated therewith to properly route the water. Some systems may also include pumps and automatic valves as well. In these systems, there is no problem associated with supercooled water as long as it is completely liquid. However, when and if the supercooled water converts to a slush, the small ice particles in the slush can cause clogging in the plumbing, the pump and/or the valves as well as cause ice accumulation in undesired locations. To overcome these problems, some known systems prevent or minimize supercooling at undesired locations by adding tap water to the system or by utilizing heaters. This results in system cooling inefficiencies as more water is cooled or water is both cooled and heated. Ideally, a system will utilize most of its cooling capacity in forming ice. In systems that have supercooling, efficiency will be maximized by converting the supercooled water to ice without adding heat to it first.

The known prior art includes U.S. Pat. No. 4,671,077, issued to Paradis, which describes a system in which water is deliberately supercooled to increase the capacity of a heat exchanger. Water having a temperature of 32° F. or warmer enters the heat exchanger and exits as supercooled water. The supercooled water is then deliberately used to make slush in a reservoir rather than on the surface of the heat exchanger itself. Part of the supercooled liquid water flowing from the heat exchanger is transformed to ice upon contact with the water in the reservoir and is used for space cooling. Alternatively, the ice obtained by this process may be filtered for various other applications, such as soft ice for packaging and preserving fish, for the preservation of certain vegetables, and for making slush drinks.

Another problem associated with ice-making systems is the lack of clarity in the ice cubes. Two contributing factors in the lack of ice clarity include flaws from internal stresses associated with rapid ice formation and/or induced by ice expansion against the mold cavity, and the entrapment of small air bubbles as liquid water converts to ice.

The solubility of air in liquid water is greater at lower temperatures than at elevated temperatures. For instance, the solubility of air in water is 2.5 times greater at 32° F. than at 203° F. Any air dissolved in the water above the concentration that can be contained by the solubility of air in ice must be released when the liquid water freezes. In slow cooling processes excess dissolved air has time to be released by the water as it slowly freezes. This is not necessarily the case in a more rapid freezing process as is found in automatic ice-making machines equipped with directly cooled ice molds. Similarly, in cases of rapid ice formation, internal strains can be associated with the forming of ice as it expands if it is unable to expand against the ice mold.

Clarity of the ice cubes can be improved by driving off trapped air before the water reaches the ice molds. However, heating the water with a heater or using hot tap water when the system is filled to eliminate trapped air has the disadvantage of adding heat to the system, and thereby lowering system efficiency.

A further problem associated with ice-making systems is the difficulty associated with achieving uniform and rapid filling of the ice mold and freezing in the ice mold. The use of a fine spray of water onto a chilled ice mold has been contemplated as can be seen, for example, in U.S. Pat. No. 4,510,144, issued to Nelson, and U.S. Pat. No. 3,908,390, issued to Dickson et al. However, excess or make-up water is abundant resulting in an inefficient system due to a loss in cooling capacity as the excess water is recirculated.

DISCLOSURE OF THE INVENTION

It is thus a general object of the present invention to provide a new and improved method and system for making ice in an ice-making machine.

It is a more particular object of the present invention to provide a method and system for electronically controlling the location of the formation of ice within a closed loop water circulating unit of an ice-making machine.

It is still a particular object of the present invention to provide a method and system for optimizing the degree of supercooling so as to eliminate the formation of slush in the plumbing of an ice-making machine.

It is another object of the present invention to provide a method and system for increasing the efficiency of a condenser associated with an ice-making machine having one or more ice molds by temporarily using one ice mold as a condenser while simultaneously having one or more ice molds act as an evaporator.

It is yet another object of the present invention to provide a method and system for improving the clarity of ice cubes without affecting the efficiency of the system.

Still further, it is an object of the present invention to provide a method and system for controlling the formation of ice cubes using a fine spray in conjunction with a chilled ice mold with little or no excess water to recirculate.

In carrying out the above objects and other objects, features and advantages, of the present invention, a method is provided for electronically controlling the location of the formation of ice within a closed loop water circulating unit of an ice-making machine. The method includes the steps of generating a first signal and providing water to the ice-making apparatus upon receipt of the first signal. The method also includes the step of generating a second signal and prohibiting the water from being provided to the ice-making apparatus upon receipt of the second signal. In addition, the method includes the step of starting the flow of water through the closed-loop water circulating unit to an icing site upon receipt of the second signal. The method further includes the step of cooling the water at the icing site as it flows through the water circulating unit of the ice-making machine. Furthermore, the method includes the steps of sensing a temperature of the water as it circulates through the water circulating unit and comparing the sensed temperature to a first predetermined temperature threshold. If the sensed temperature is below the first predetermined temperature threshold, a third signal is generated. The method further includes the step of stopping the flow of water through the closed-loop water circulating unit upon receipt of the third signal. After a first predetermined amount of time, a fourth signal is generated. Still further, the method includes the step of restarting the flow of water to the icing site upon receipt of the fourth signal.

In further carrying out the above objects and other objects, features and advantages, of the present invention, a system is also provided for carrying out the steps of the above described method. The system includes a sensor for sensing the temperature of the water as it flows through the closed-loop water circulating unit. The system also includes a controller for generating the first, second, third and fourth signals.

Still further, in carrying out the above objects and other objects, features and advantages, of the present invention, an apparatus is provided for carrying out the steps of the above-described method. The apparatus includes a closed loop water circulating unit including a water inlet fluidly coupled to a water supply, a water manifold in fluid communication with the water inlet, and an ice mold adapted to receive a flow of refrigerant. The closed loop water circulating unit also includes a reservoir for collecting excess water and a pump for transferring the water from the reservoir to the water manifold. The apparatus further includes a valve for controlling the flow of water from the water supply to the closed loop water circulating unit and a sensor for sensing the temperature of water in the closed loop water circulating unit. Finally, the apparatus includes a controller for generating a first, second, third, and fourth signal. The first signal initiates the transfer of water from the water supply to the water inlet. The second signal stops the flow of water from the water supply when the ice-making apparatus is charged with water and starts the pump to circulate the water through the apparatus. The third signal stops the flow of water by turning off the pump if the sensed temperature falls below a first predetermined temperature threshold. The fourth signal generated by the controller restarts the flow of water by turning on the pump.

Still further, in carrying out the above objects and other objects, features and advantages, of the present invention, a method is provided for making ice while generating little or no excess water. The method includes the step of cooling an ice mold to obtain a chilled ice mold. The method also includes the step of supercooling the water to be applied to the chilled ice mold to obtain supercooled water. The method also includes the step of spraying the supercooled water onto the chilled ice mold, thereby reducing the amount of excess water.

In carrying out the above objects and other objects, a system is also provided for carrying out the steps of the above-described method. The system includes means for cooling an ice mold to obtain a chilled mold. The system also includes means for supercooling the water to be applied to the chilled ice mold. Finally, the system includes a sprayer for spraying the supercooled water onto the chilled ice mold so as to reduce the amount of excess water.

The above objects, as well as other objects, features and advantages of the present invention are readily apparent from the following detailed description of the best modes for carrying out the invention when taken in connection with the accompanying drawings.

BEST MODES FOR CARRYING OUT THE INVENTION

Figure 2:
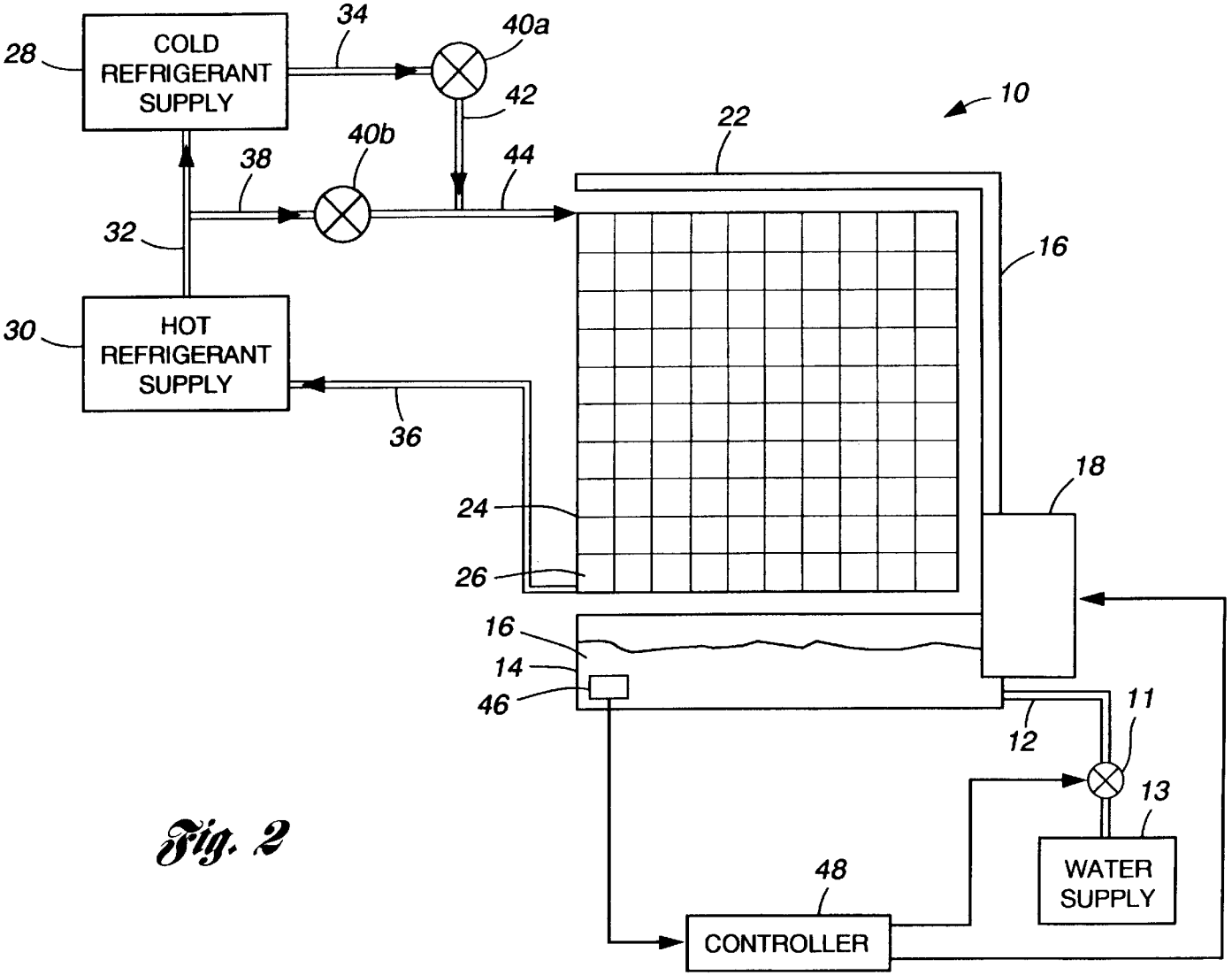
FIG. 2 is a schematic diagram of the preferred embodiment of the system of the present invention.

Turning now to FIG. 2, there is shown a schematic diagram of the ice-making system of the preferred embodiment of the present invention, denoted generally by reference numeral 10. The system 10 includes a water inlet line 12 for receiving water from a water supply 13. A valve 11 is provided in fluid communication between the water inlet line 12 and the water supply 13. The valve 11 controls the flow of water from the water supply 13 to the water inlet line 12.

The water inlet line 12 transfers the water 16 to a reservoir 14. When sufficient water is supplied to the reservoir 14, the water inlet line 12 is shut off and a pump 18 pumps the water 16 from the reservoir 14 into a manifold 22. The manifold 22 has holes (not shown) that allow the water 16 to flow down and across an ice mold 24. The flowing water 16 passes across the surfaces of individual ice mold cavities 26 of the ice mold 24.

The system 10 of the present invention also includes a cold refrigerant supply 28 acting as a condenser and a hot refrigerant supply 30 acting as a compressor. The cold refrigerant supply 28 includes an inlet line 32 from the hot refrigerant supply 30 and an outlet line 34. The hot refrigerant supply 30 includes an inlet line 36 from the ice mold 24 and the cold refrigerant inlet line 32 to the cold refrigerant supply 28. A hot refrigerant supplemental outlet line 38 is also provided. A first valve 40*a* couples the cold refrigerant supply 28 to the ice mold 24 via a first mold inlet 42. Similarly, a second valve 40*b* couples the hot refrigerant supply 34 to the ice mold 24 via a second mold inlet line 44. The first valve 40*a* and the second valve 40*b* may be replaced by a single double-acting valve (not shown).

When the system 10 is turned on, cold refrigerant from the cold refrigerant supply 28 is supplied to the ice mold 24 via the first valve 40*a*. The second valve 40*b* is closed. Cold refrigerant vapor or cold mixed phase refrigerant (liquid+vapor) is passed through the cold refrigerant outlet line 34 and the first mold inlet line 42. This allows the ice mold 24 to function as an evaporator. The evaporated refrigerant is then routed back to the hot refrigerant supply 30 through the hot refrigerant inlet line 36.

The first valve 40*a* also functions as an expansion device to lower the temperature of the refrigerant before it reaches the ice mold 24. When the first valve 40*a* routes the cold refrigerant through the ice mold 24, the ice mold cavities 26 are rapidly cooled along with the water 16 that flows across the ice mold cavities 26. The cooled water 16 eventually flows back to the reservoir 14 and is eventually circulated back to the manifold 22 through the pump 18. As the water 16 is circulated through the system 10, the temperature of the water throughout the system 10 is steadily diminished. Once ice formation is complete, the harvesting of the ice is initiated by closing the first valve 40*a* and opening the second valve 40*b*. This has the effect of forcing the ice mold 24 to act as a condenser while removing the evaporator function from the system.

The initially ice-free surfaces of the ice mold cavities 26 and the continually moving water 16 in the system 10 combine to allow a supercooling condition to occur in the water. In existing systems, this supercooling of the water 16 can easily reach a temperature of 24° F. Slush forms throughout the system when supercooling reaches a system, pressure and water impurity dependent lower limit, e.g., 24° F. in some systems. Once the temperature of the water 16 in the reservoir 14 falls below the lower temperature limit, natural vibrations in the system 10 may cause freezing to begin. Typically, this starts at the nozzles in the manifold 22. Once the freezing is initiated, the water 16 may be converted to slush throughout the system 10 and flow through the nozzles of the manifold 22 and/or the pump 18 stops or slows. This slush problem can be circumvented if ice formation can be initiated on the ice mold 24 before an unstable level of supercooling is reached. Once ice formation is initiated on the ice mold 24, the heat of fusion given up by the ice prevents the unfrozen water flowing across the ice mold 24 from retaining any significant degree of supercooling since water in contact with ice tends to maintain an equilibrium temperature of 32° F.

The system 10 of the present invention utilizes a temperature sensor 46 to monitor the temperature of the flowing water. Preferably, the sensor 46 is located in the reservoir 14. An uninsulated reservoir 14 might never reach a supercooled condition since it absorbs heat from ambient air. This would eliminate or minimize supercooling, but would waste cooling capacity. However, an insulated reservoir would waste little cooling capacity, but would be very likely to reach a supercooled state and, thus, require the seeding technique of the present invention.

Coupled between the sensor 46 and the pump 18 is a controller 48. When an ideal degree of supercooling has been reached, the controller 48 shuts off the pump 18. The water flowing across the ice mold 24 then runs off the ice mold 24 leaving behind a few droplets. Without the warming action of the flowing water, the ice mold cavities 26, being part of the evaporator, rapidly drop in temperature and thereby create an extreme degree of supercooling in the stationary water droplets left behind. The stationary water droplets then rapidly freeze.

The controller 48 reactivates the pump 18 after a short period of time, such as a few seconds. When the pump 18 is turned back on, the flow of water across the ice mold 24 resumes. However, the frozen droplets in contact with the supercooled water form crystal "seeds" upon which the flowing water freezes. Rather than convert to 32° F. slush, the supercooled flowing water converts to 32° F. liquid water as it freezes onto the ice seeds and liberates the "heat of fusion" of the water. The 32° F. water returning to the reservoir 14 rapidly raises the temperature of the water in the reservoir 14 to 32° F.

Seeding can be verified by monitoring the rate at which the temperature of the water in the reservoir 14 rises. If temperature sensor 46 fails to detect a temperature rise to 32° F. in the reservoir 14 after an appropriate time interval, e.g., 10 seconds, the controller 48 momentarily shuts off the pump 18 to reinitiate the seeding process. This pump stopping and temperature measurement process continues to cycle until a successful seeding has been detected after which point the pump 18 remains on. Upon accomplishing the seeding process, the supercooling is removed from the system 10 and ice formation takes place at the desired location, i.e., the ice mold 24.

Alternatively, it may be desirable to initiate ice seeding at a temperature above freezing. If seeding is initiated at too high a temperature, however, the flowing water would melt the ice seed once the pump is reinitiated. Ice seeding can be verified by monitoring the temperature of the reservoir. For example, if ice seeding is initiated at a water temperature of 36° F., the temperature of the water would be expected to slowly drop to 32° F. If the temperature dropped below 32° F., however, this is an indication that seeding has failed.

When sufficient time has passed after the seeding process, the ice mold 24 is filled with ice. The controller 48 shuts off the pump 18. The valve 40*a* closes to disconnect the cold refrigerant outlet line 34 from the mold inlet lines 42 and 44. The valve 40*b* then opens to connect the hot refrigerant supplemental outlet line 38 to the mold inlet line 44. The hot refrigerant vapor rapidly raises the temperature of the ice mold 24 above 32° F. This in turn melts the ice immediately in contact with the surfaces of the ice mold cavities 26. Once the surface ice is melted, the ice cubes rapidly release from the ice mold cavities 26 and fall into a collection bin (not shown). The water inlet line 12 is then opened to refill the reservoir 14 from the water supply 13 and the process is repeated as required.

Figure 3A:
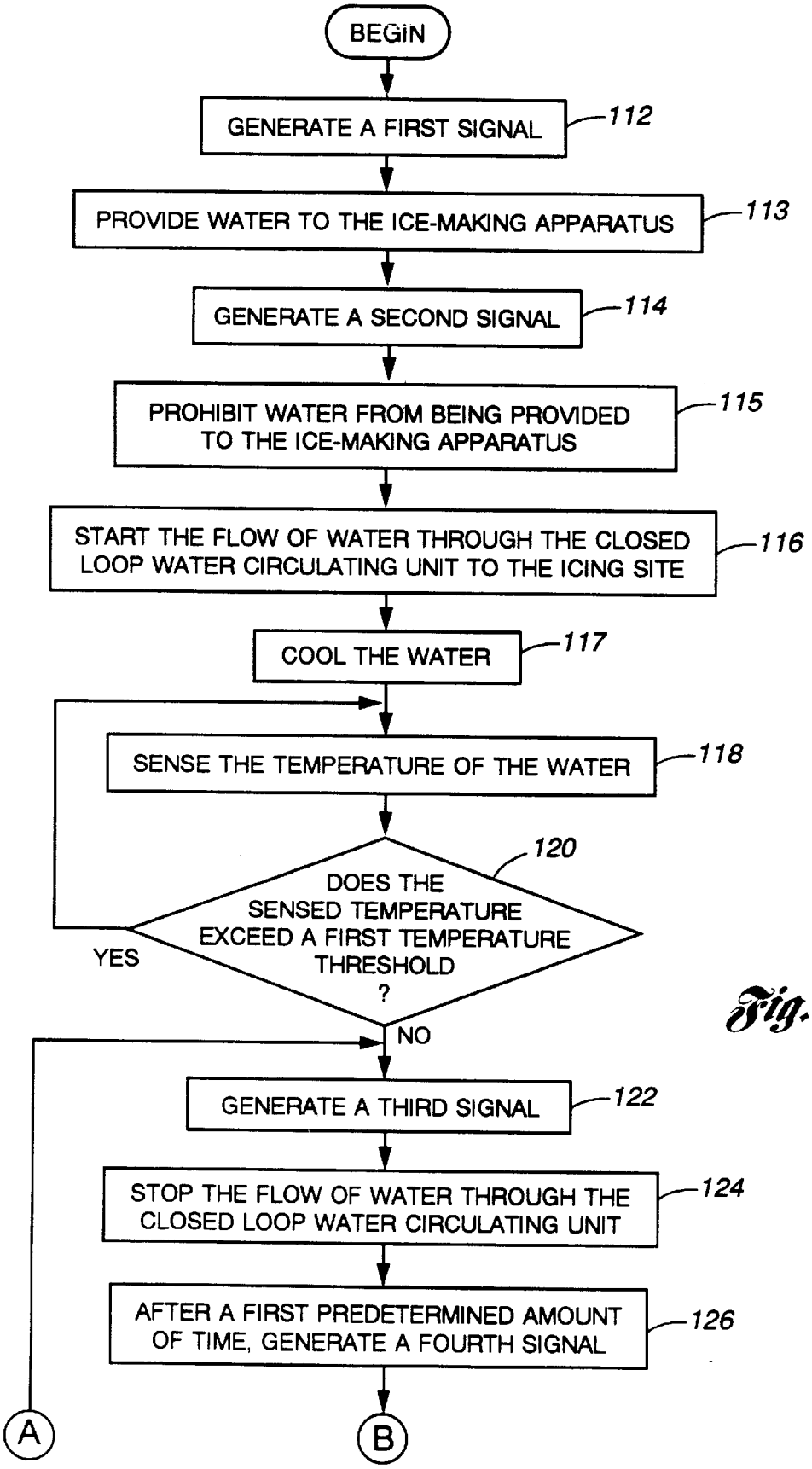
FIGS. 3*a* and 3*b* are flow diagrams illustrating the sequence of steps associated with the method of the preferred embodiment of the present invention.
Figure 3B:
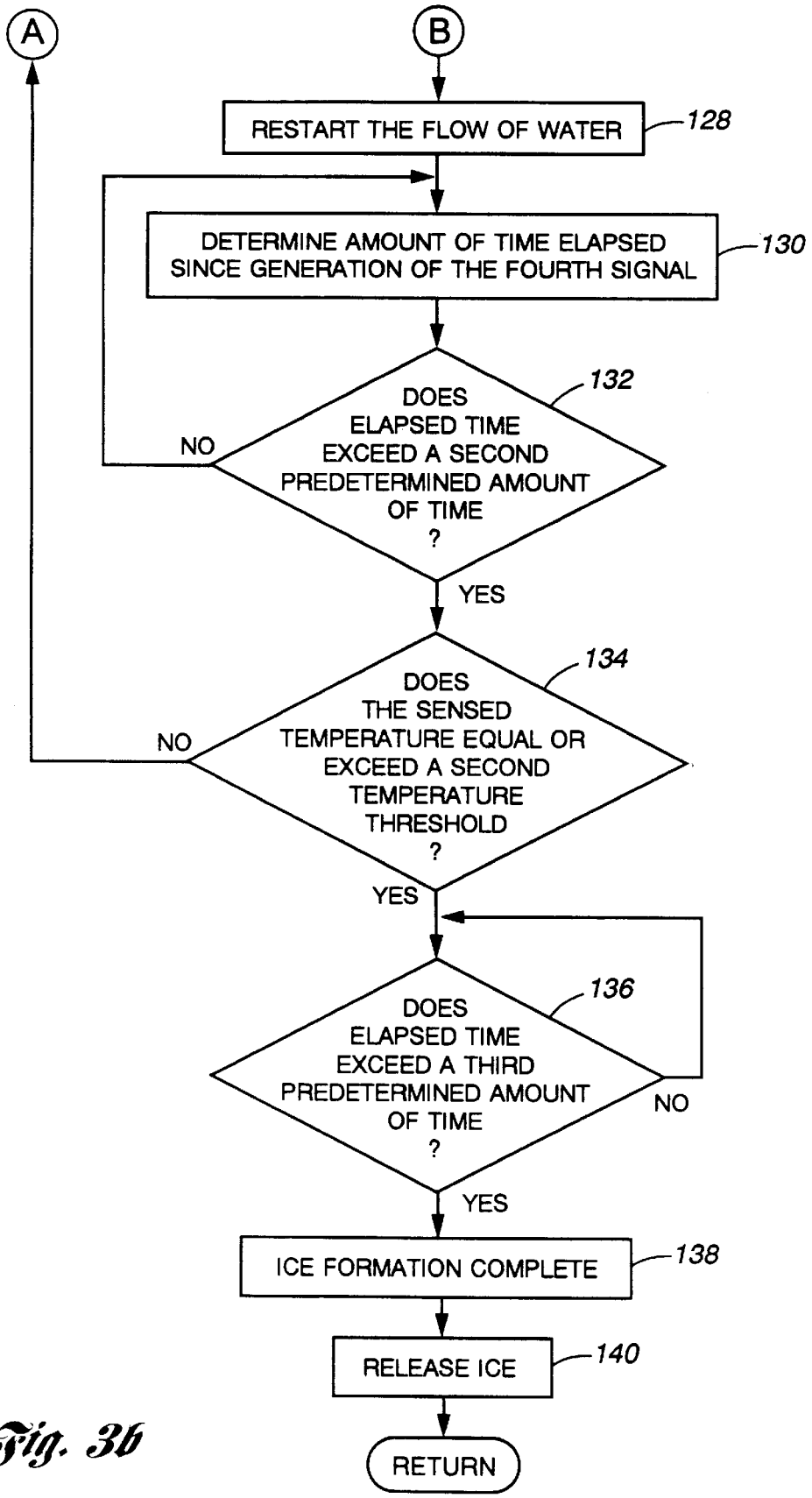

Referring now to FIGS. 3*a* and 3*b*, there is shown a flow diagram illustrating the sequence of steps associated with the preferred embodiment of the present invention. The method begins with the step of generating a first signal, as shown at block 112. Next, the method continues with the step of providing water to the ice-making apparatus upon receipt of the first signal, as shown at block 113. Next, the method continues with the step of generating a second signal, as shown at block 114. Upon receipt of the second signal, water is prohibited from being provided to the ice-making apparatus and the flow of water to the icing site through the closed loop water circulating unit is initiated, as shown at blocks 115 and 116, respectively.

The controller 48 generates the first signal for receipt by the valve 11 to supply the ice-making apparatus with water from the water supply. The controller 48 also generates the second signal for receipt by the valve 11 and the pump 18 to stop the flow of water from the water supply and to start the flow of water to the manifold 22 and across the ice mold 24.

The method continues with the step of cooling the water as it flows through the circulating unit, as shown at block 117. That is, cold refrigerant is routed to the ice mold 24 so that the water is cooled as it flows across the ice mold 24. Also, as the cooled water collects in the reservoir 14 and continues to circulate, the temperature of the water in the reservoir 14 continues to drop. Therefore, the temperature of the water diminishes as it circulates through the system 10.

The method proceeds with the step of sensing the temperature of the water, as shown at block 118. Preferably, the temperature sensor 46 is located in the reservoir 14. Next, the sensed temperature is compared to a first predetermined temperature threshold, e.g., 27° F., as shown at conditional block 120. If the temperature of the water exceeds the first temperature threshold, and the seeding process has not been initiated yet, the system 10 continues sensing the temperature of the water, as shown at conditional block 120. However, if the temperature of the water falls below the first temperature threshold, a third signal is generated, as shown at block 122.

The flow of water through the closed-loop water circulating unit is stopped upon receipt of the third signal, as shown at block 124. The pump 18 receives the third signal from the controller 48 and shuts off. The water flow is stopped before an unstable level of supercooling is reached. Also, seeding is allowed to occur on the ice mold 24. Next, the method continues with the step of generating a fourth signal after a first predetermined amount of time after generating the third signal, as shown at block 126. After sufficient time has passed to allow seeding to occur, the fourth signal is generated. Upon receipt of the fourth signal, the pump 18 restarts the flow of water to the ice mold 24, as shown at block 128.

If it is desirable to verify seeding before making ice, the method includes the step of detecting a successful seeding. An amount of time elapsed since the generation of the fourth signal is determined, as shown at conditional block 130. The elapsed time is then compared to a second time threshold, e.g., 10 seconds, as shown at conditional block 132. If the elapsed time does not exceed the second time threshold, the method continues to determine the elapsed time until the second time threshold has been exceeded.

If the elapsed time has exceeded the second time threshold, the sensed temperature is compared to a second predetermined temperature threshold, e.g., 32° F., as shown at conditional block 134. If the sensed temperature is less than the second temperature threshold, the method returns to generate the third signal, as shown at block 122, and the method continues to attempt to seed the ice mold 24.

If the sensed temperature equals or exceeds the second temperature threshold, the method continues with the step of determining whether the elapsed time exceeds a third predetermined amount of time, as shown at conditional block 136. If the elapsed time has not exceeded the third predetermined time threshold, the method continues to monitor the elapsed time until it exceeds the third predetermined time threshold indicating that ice formation is complete. Once the elapsed time has exceeded the third predetermined time threshold, ice formation is complete, as shown at block 138 and the ice is released, as shown at block 140. The method proceeds to repeat the entire process.

Figure 4:
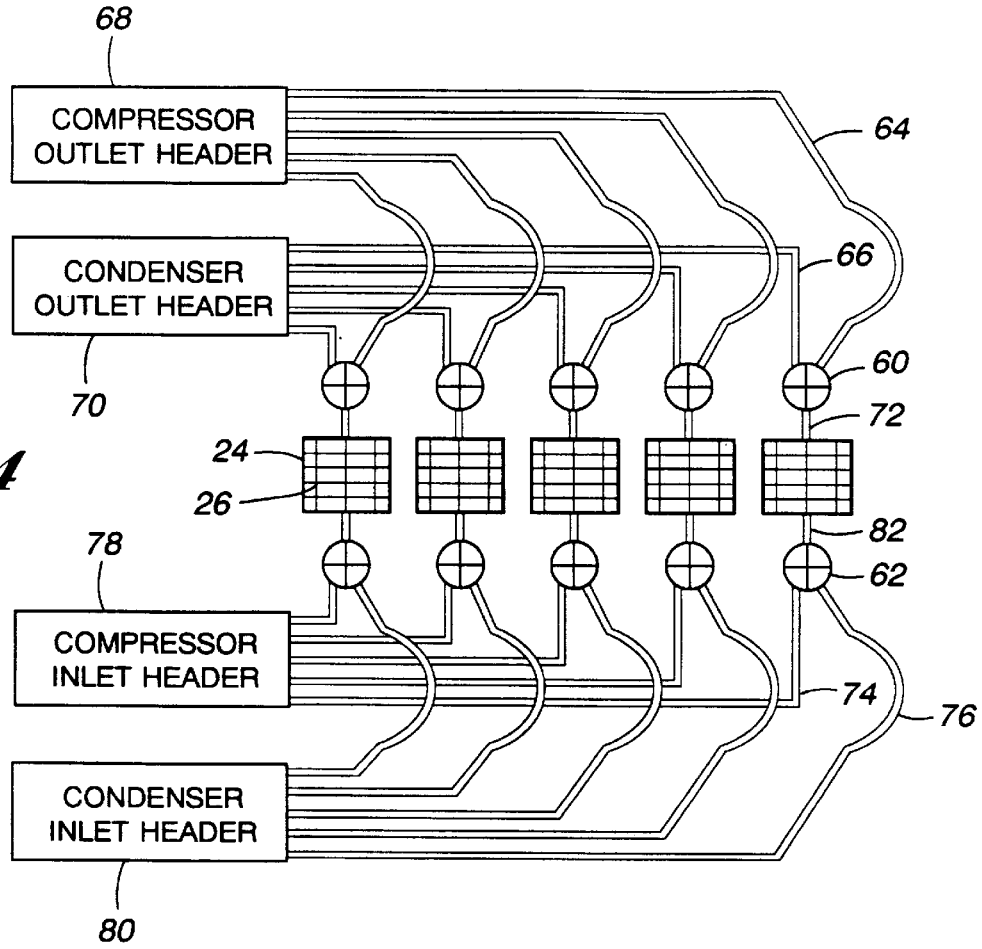
FIG. 4 is a schematic diagram of a second embodiment of the system of the present invention.

Turning now to FIG. 4, there is shown the system 10 of the present invention having a plurality of ice molds 24 each containing cavities 26 in which to form the ice cubes. Each ice mold 24 is equipped with an inlet valve 60 and an outlet valve 62. The plumbing associated with the water system is not shown, but is comparable to that of FIG. 2. However, there are geometry changes required to accommodate the presence of the extra valves 60, 62 and the extra refrigerant plumbing lines. Ideally, the plurality of ice molds 24 would have a common reservoir 14 and a common pump 18 but separate manifolds 22.

Each inlet valve 60 has an inlet refrigerant line 64, 66 from a corresponding compressor outlet header 68 and a corresponding condenser (or expansion device) outlet header 70, respectively. Each inlet valve 60 is able to pass refrigerant to its associated ice mold 24 via a first refrigerant line 72.

Each outlet valve 62 has an outlet refrigerant line 74, 76 going to a corresponding compressor inlet header 78 and a corresponding condenser inlet header 80, respectively. Each outlet valve 62 is able to receive refrigerant from its associated ice mold 24 via a second refrigerant line 82. Preferably, each of the refrigerant lines 64, 66, 72, 74, 76 and 82 are insulated to maximize the efficiency of the system 10.

The feature of the system 10 of the invention as shown in FIG. 4 is illustrated utilizing five ice molds 24. However, it should be appreciated that the present invention applies to any number of ice molds 24. Assuming an ice cube formation time of eight minutes, the five ice molds 24 are operated at two minute intervals in a successive manner. First, the reservoir 14 is filled with water and cold refrigerant is routed to each of the five ice molds 24. The water then flows across each of the five ice molds 24 until the desired temperature of the reservoir 14 is sensed by the sensor 46. Once the desired temperature is reached, the flow of water is prohibited across each of the molds 24. With the cessation of water flow, each of the five molds 24 begin seeding.

Water flow is then resumed across the first ice mold 24 and ice formation begins. If necessary, the seeding process is repeated on the first ice mold 24 until seeding occurs. After two minutes, water flow and, if necessary, seeding is initiated on the second ice mold 24. After another two minutes, water flow and any necessary seeding is initiated on the third ice mold 24. Two minutes later the same step is performed for the fourth ice mold 24. Another two minutes later the same process is initiated on the fifth ice mold 24.

Now that eight minutes has elapsed, ice formation is complete on the first ice mold 24. At the same time that water flow is initiated on the fifth ice mold 24, the valves 60, 62 associated with the first ice mold 24 will switch. Instead of routing cold refrigerant from the compressor outlet header 68 to the compressor inlet header 78, hot refrigerant is routed from the condenser outlet header 70 to the condenser inlet header 80. The hot refrigerant warms the first ice mold 24 until the ice cubes are released from the ice mold cavities 26. At this time, the first ice mold 24 effectively acts as a condenser and lowers the temperature of the high pressure refrigerant that is passed to the condenser inlet header 80 of a true condenser (not shown), thus increasing the cooling capacity of the system 10.

After sufficient time has passed to release the ice cubes, preferably less than one minute, the valves 60, 62 associated with the first ice mold 24 switch back to the cold refrigerant compressor outlet header 68 and the compressor inlet header 78. Additional water may be added to the reservoir 14 at this time to make up for any water lost to the formation of ice cubes.

After two minutes has passed from the initiation of water flow and/or seeding at the fifth ice mold 24, the first ice mold 24 is seeded and water flow across the first ice mold 24 is re-initiated. Simultaneously, hot refrigerant is routed to the second ice mold 24 to permit the release of the ice cubes on the second ice mold 24 since eight minutes has elapsed from the initiation of ice formation in the second ice mold 24. Subsequently at two minute intervals, each ice mold 24 is temporarily switched into condenser mode, the reservoir 14 is refilled and the next ice mold 24 is seeded and subjected to flowing water.

This process allows the heat used to release the ice cubes to be extracted from the refrigerant that is being used to form additional ice cubes. The efficiency of the system is maximized and the cooling capacity is increased resulting in a shorter cycle for forming ice. If each of the ice molds were operated simultaneously, the increased cooling capacity achieved during the release of the ice cubes would be wasted since water would not be flowing across any of the ice molds 24. The ice cube formation time would then be greater than that of a similar-sized cooling system used in a staggered operation.

If the water can be heated before it is used for making ice, the solubility of the water to air is reduced as well as the content of dissolved air. If the water is frozen before it reabsorbs air, the formation of small air bubbles in the resulting ice can be reduced thereby improving the clarity of the ice. However, preheating water requires added energy which decreases the overall energy efficiency of the ice-making system. However, this problem can be circumvented by using the system shown in FIG. 5.

Figure 5:
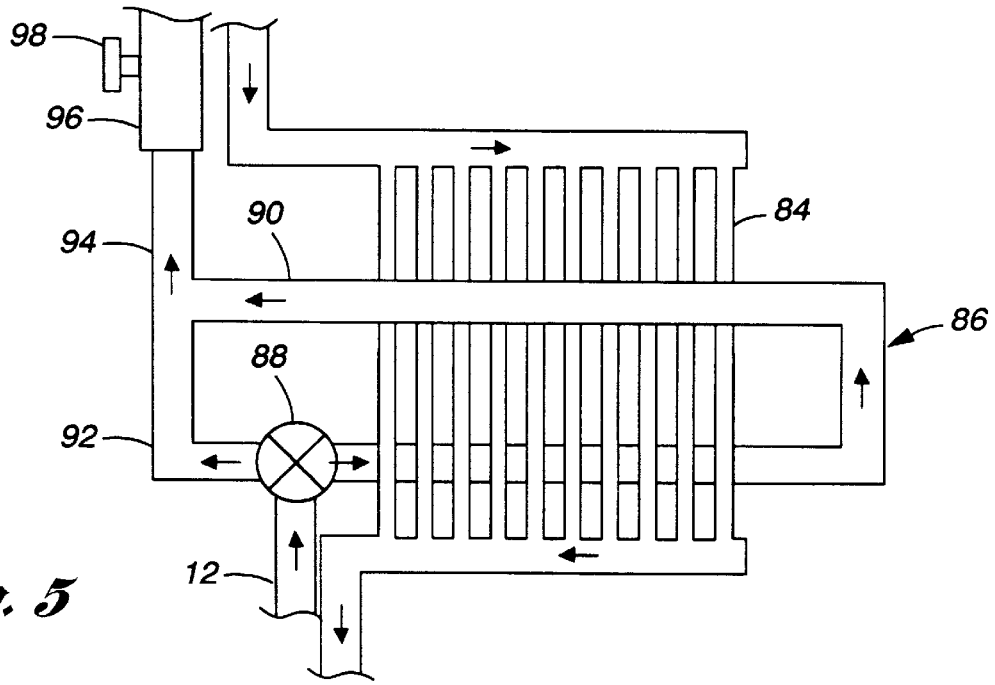
FIG. 5 is a schematic diagram of the preheating feature of the preferred embodiment of the system of the present invention.

As shown in FIG. 5, a condenser 84 is wrapped with a water line 86 fluidly coupled to the water inlet line 12. A routing valve 88 is disposed in the water line 86. The routing valve 88 routes all or a portion of the water received from the water inlet line 12 around the condenser 84. The water passing around the condenser 84 is heated by the heat rejected from the condenser 84. As the water is heated, the heat rejection capability of the condenser 84 is correspondingly increased. As a result, the cooling capacity of the system is increased without increasing the energy consumption of the system.

The heated water portion 90 is then mixed with an unheated water portion 92, if any, that bypassed the condenser 84. The combined water 94 is then passed to the ice-making system 10. Referring to FIG. 3, the step of preheating the flow of water is performed just before step 113.

The water inlet line 12 is connected to an insulated water line 96 having a relief valve 98 or an insulated sump in which air that is released from the heated water can be outgassed. Preferably, the warm outgassed water is passed through a heat exchanger (not shown) where it is cooled to room temperature without exposing the warm water to air and without expending cooling capacity. The resulting lukewarm water is then passed to the ice-making system 10 where it produces ice with fewer bubbles than if it had not been heated. If the heated water is passed directly to the ice-making system 10 and outgassing is performed in the reservoir 14, the plumbing is simplified but the cooling capacity is reduced since heat from the condenser will be returned to the system 10.

Figure 1:
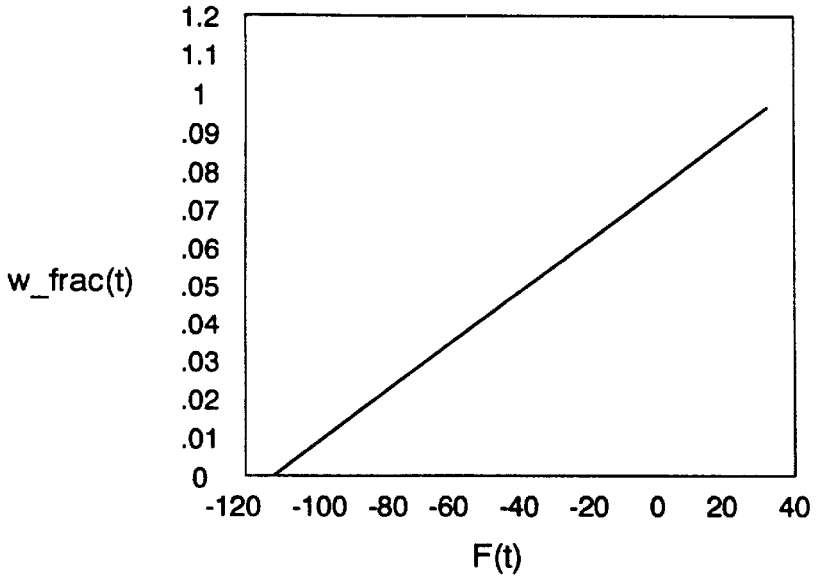
FIG. 1 is a graph illustrating the fraction of liquid water in a slush mixture as a function of the initial temperature of supercooled water.
Figure 6:
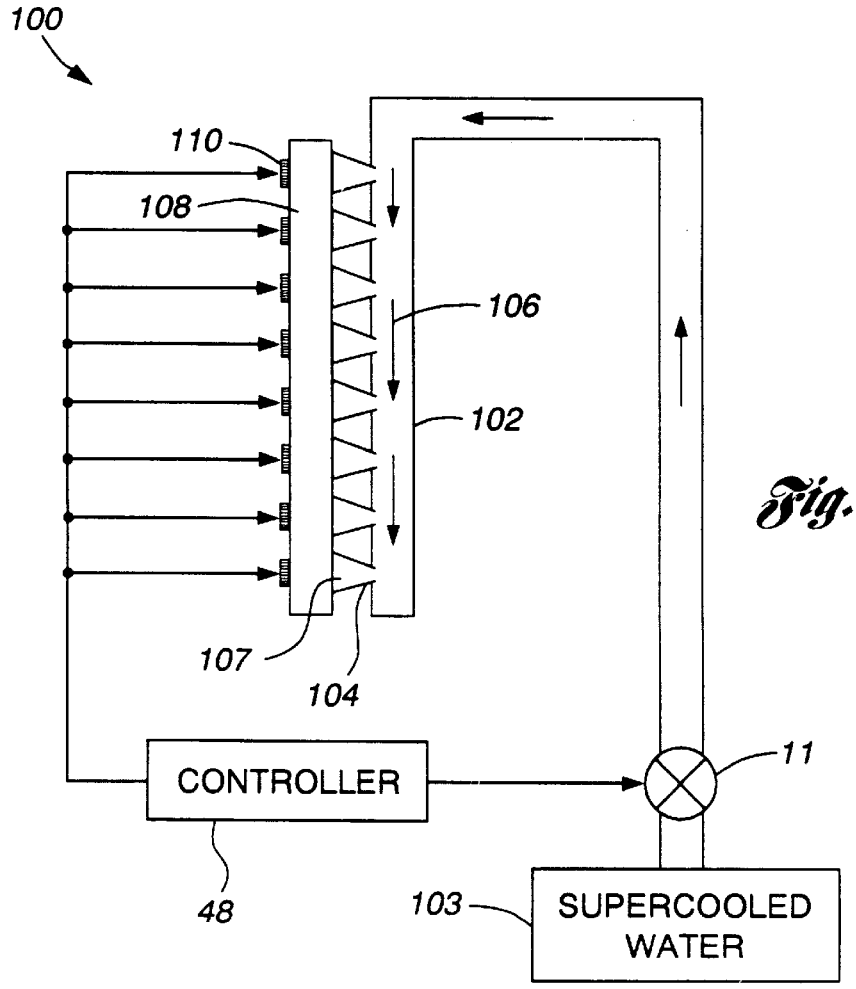
FIG. 6 is a schematic diagram of a third embodiment of the system of the present invention.

Turning now to FIG. 6, there is shown a portion of a simplified ice-making system 100. The system 100 includes a water manifold 102 having one or more spray nozzles or atomizers 104. Pressurized supercooled water 106 is delivered to the water manifold 102 from a supply 103 of supercooled water. The advantage of the supercooled water 106 is that the speed of ice formation is increased. The spray nozzles 104 produce a spray 107 of small supercooled water droplets that is directed onto a chilled ice-making mold 108. The chilled ice mold 108 can be cooled conventionally with evaporating refrigerant (not shown) or with Peltier devices 110.

When the spray 107 strikes the chilled ice mold 108 the water droplets freeze upon contact. When the ice cubes are completely formed, the controller 48 reverses the polarity of the current driving the Peltier effect devices 110 thereby converting the Peltier devices 110 to heaters. Consequently, the ice mold 108 will heat and release the ice cubes. In the case of refrigerant based cooling system, the refrigerant plumbing is switched via valves to temporarily convert the ice mold 108 into a condenser for a sufficient time to release the ice cubes.

In a further refinement, it is possible to increase the degree of supercooling in the spray by subjecting the cooled water to high pressure which lowers the freezing temperature. Alternatively, the water spray can be reduced to a sufficiently fine mist and the ice mold can be cooled at a sufficient rate to prevent the formation of make-up water without having to supercool the water. This prevents the formation of ice at the spray nozzles or at other undesired locations in the system. For certain combinations of mist density and ice mold cooling rates, it is possible to avoid the formation of make-up water without having to cool the water before it is transformed to mist. This simplifies the cooling system by not having to provide means for separately cooling the water and the ice molds.

The advantages of the present invention are numerous. First, the formation of slush in the system is eliminated. Second, energy management is improved to minimize cooling time and energy consumption. Third, ice clarity is improved by preheating the water before initiating the formation of ice. Fourth, the use of supercooled water in conjunction with spray nozzles or atomizers increase the uniformity of ice cubes and decrease the cooling time. Finally, the use of Peltier devices eliminate the complexity of a refrigerant-based cooling system.

While the best modes for carrying out the invention have been described in detail, those familiar with the art to which this invention relates will recognize various alternative designs and embodiments for practicing the invention as defined by the following claims.

What is claimed is:

1. For use with an ice-making apparatus having at least one icing site and a water manifold for providing water to the at least one icing site, a method for making ice comprising:

(a) cooling the at least one icing site to obtain a chilled icing site;

(b) providing the water to the water manifold; and (c) spraying the water onto the chilled icing site at a predetermined density correlated to a cooling rate at said icing site so that an amount of the water sprayed that is converted to ice upon contact with the chilled icing site is maximized.

2. The method as recited in claim 1 further comprising the step of cooling the water to obtain supercooled water prior to step (b).

3. The method as recited in claim 2 wherein the step of cooling the water includes the step of subjecting the water to pressure.

4. The method as recited in claim 1 wherein the step of providing the water to the water manifold includes the step of cooling the water delivered to the water manifold.

5. The method as recited in claim 1 wherein the step of cooling the at least one icing site is performed utilizing an evaporator.

6. The method as recited in claim 1 wherein the step of cooling the at least one icing site is performed utilizing a Peltier device.

7. For use with an ice-making apparatus having at least one icing site for making ice and a supply of water to supply water to the icing site, a system for making ice comprising:

means for cooling the at least one icing site to obtain a chilled icing site; and a sprayer for spraying the water onto the chilled icing site at a predetermined density correlated to a cooling rate at said icing site so that an amount of the water sprayed that is converted to ice upon contact with the chilled icing site is maximized.

8. The system as recited in claim 7 further comprising means for cooling the water to obtain supercooled water.

9. The system as recited in claim 8 wherein the means for cooling the water includes means for pressurizing the water to obtain pressurized water.

10. The system as recited in claim 7 wherein the means for cooling the at least one icing site is an evaporator.

11. The system as recited in claim 7 wherein the means for cooling the at least one icing site is a Peltier device.

* * * * *